US006712649B2

(12) United States Patent
Mano et al.

(10) Patent No.: US 6,712,649 B2
(45) Date of Patent: Mar. 30, 2004

(54) PLUG

(75) Inventors: Nobuyuki Mano, Tokyo (JP); Takeshi Matsuda, Tokyo (JP); Fumio Nozaki, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/033,684

(22) Filed: Dec. 27, 2001

(65) Prior Publication Data

US 2003/0124916 A1 Jul. 3, 2003

(51) Int. Cl.[7] ..... H01R 4/48
(52) U.S. Cl. ..... 439/835; 439/834; 439/441
(58) Field of Search ..... 439/835, 834, 439/441, 828, 775, 786

(56) References Cited

U.S. PATENT DOCUMENTS

| | | | | |
|---|---|---|---|---|
| 1,666,991 A | | 4/1928 | Cohen | |
| 2,505,918 A | * | 5/1950 | Shoucair | 173/361 |
| 4,413,872 A | | 11/1983 | Rudy, Jr. et al. | 339/95 M |
| 4,764,129 A | | 8/1988 | Jones et al. | 439/677 |
| 6,261,120 B1 | * | 7/2001 | Beege et al. | 439/441 |

FOREIGN PATENT DOCUMENTS

| | | | |
|---|---|---|---|
| DE | 718027 | 2/1942 | |
| EP | 0445 973 | 9/1991 | H01R/9/07 |
| FR | 1599853 | 7/1970 | |
| FR | 2394187 | 1/1979 | H01R/9/04 |
| GB | 2158655 | 11/1985 | H01R/13/58 |
| GB | 2282494 | 4/1995 | H01R/4/28 |
| WO | 87/01244 | 2/1987 | H01R/4/48 |

* cited by examiner

*Primary Examiner*—Alexander Gilman
(74) *Attorney, Agent, or Firm*—Darby & Darby

(57) ABSTRACT

A versatile plug which prevents signal and ground wires in pairs from being connected in reversed polarity; prevents short circuits occurring in adjacent lead wires; facilitates lead wire connecting operation; and which allows connection of lead wires of different types, has a pair of plug-side contact terminals contacted by a pair of apparatus-side terminals; a plug housing having an asymmetrical profile in conformity with a configuration of an apparatus-side connection recess; and a clamp detachably attached to each of the lead wires. By inserting the plug into the connection recess, the paired lead wires can be electrically connected to the paired apparatus-side terminals. Since the plug housing has an asymmetrical configuration, no reversed polarity connection occurs. A lead wire of any given thickness can be connected to the plug-side contact terminal by clamping with the clamp.

9 Claims, 10 Drawing Sheets

FIG. 5
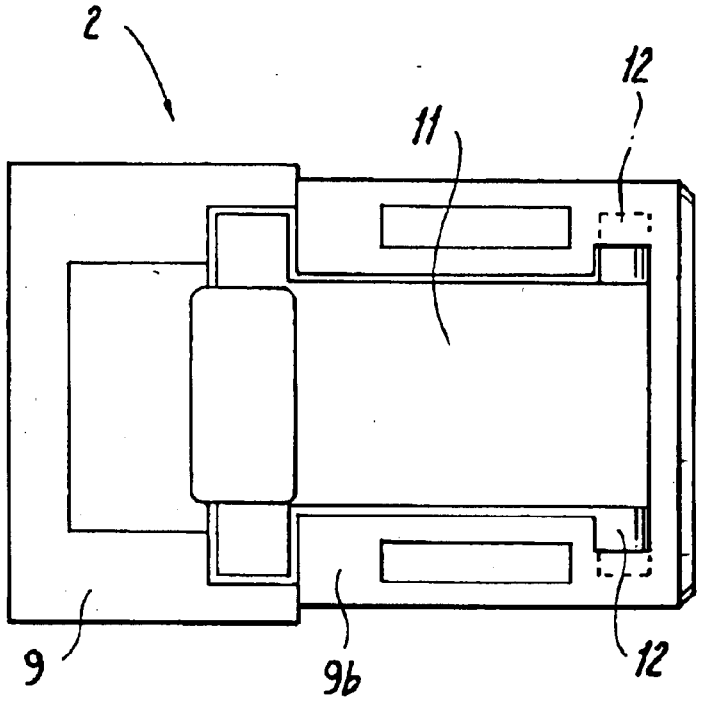
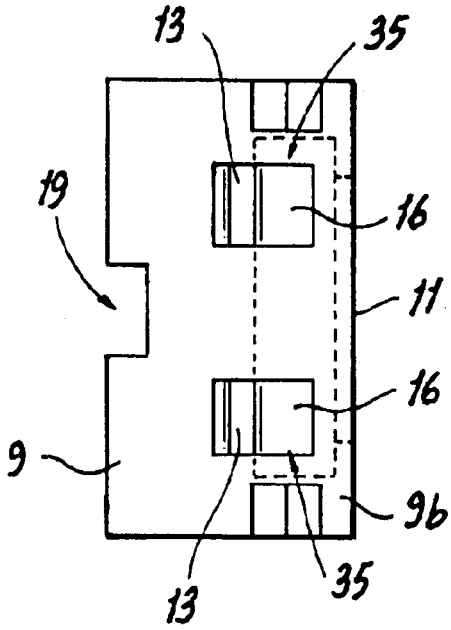
FIG. 6

FIG. 7
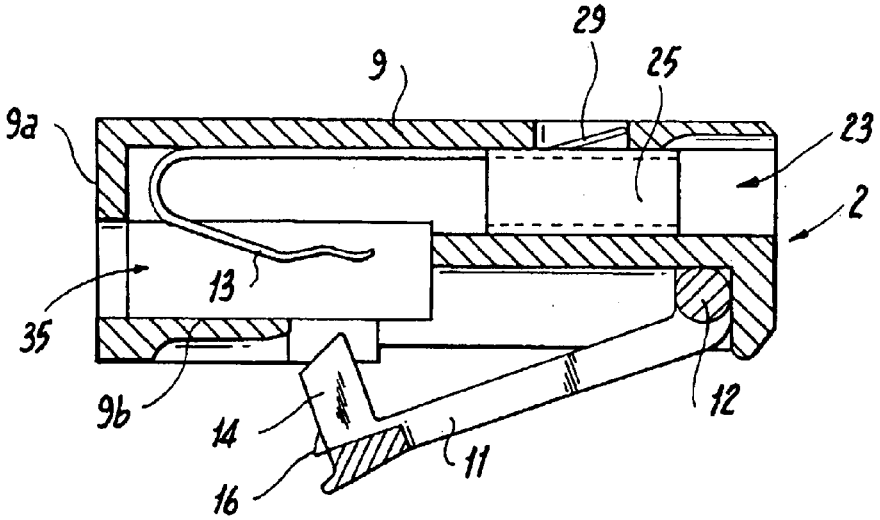
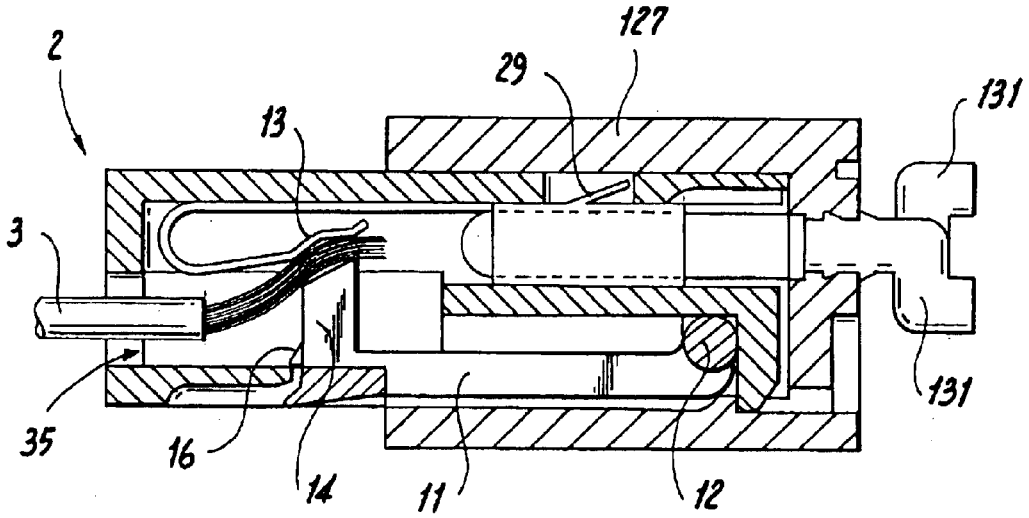
FIG. 8

FIG. 9a
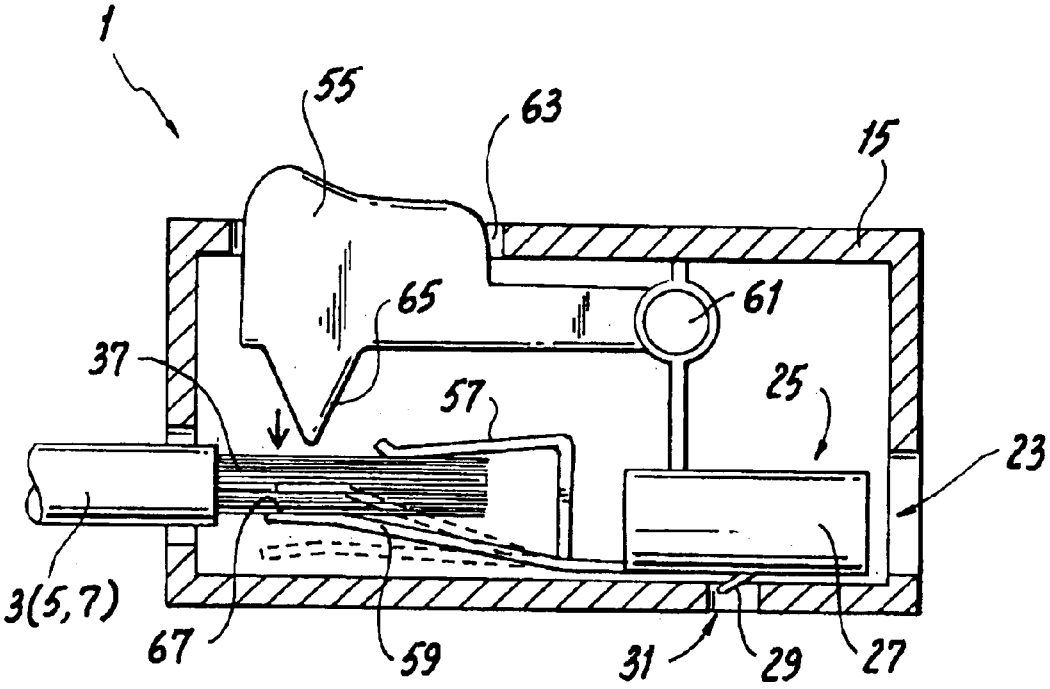
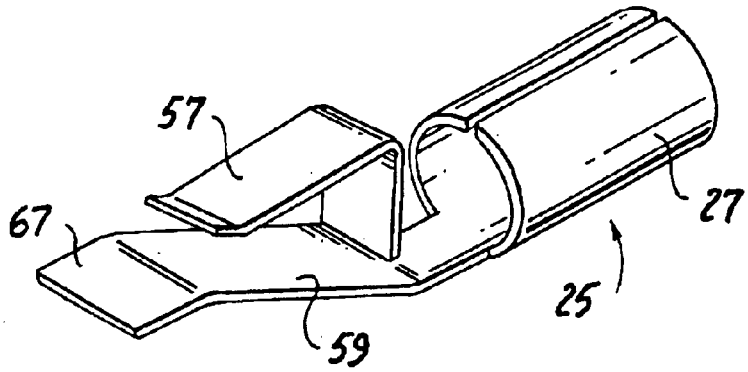
FIG. 9b

PLUG

BACKGROUND OF THE INVENTION

1. Field of the Invention

The present invention relates to a plug structure for connecting a pair of lead wires comprising a signal wire and a ground wire to an apparatus such as an audio apparatus.

2. Description of the Related Art

In an apparatus employing a lead wire for wiring, for example, an audio apparatus, an amplifier and a speaker are connected to each other by a pair of lead wires comprising a signal wire and a ground wire. Connection between a lead wire and such an apparatus is usually established as follows. As shown in FIG. 11, a lead wire is, at its skinned end, connected to a connector, called a lever terminal 103, attached to a terminal plate 101 provided on the back-surface side of the apparatus.

That is, a lever 105 is rotated in a clockwise direction viewing the figure against a force of a torsion spring 107, and a skinned end of a lead wire 109 is inserted into an insertion hole 111 of the lever terminal 103. Upon a return of the lever 105 to its original position, the lead wire 109 is caught in between a metal contactor 113, which is formed integrally with the lever 105, and a metal contactor 117 formed inside a housing 115 of the lever terminal 103, and is thereby connected to the metal contactor 117.

However, modem audio apparatuses, in contrast to conventional ones having a 2-channel system, have come to have a 4- or 6-channel system, i.e. require a larger number of speakers. This requires that the lead wire 109, formed by using a signal and a ground wire in combination, be separately connected to each of the speakers. Consequently, as shown in FIG. 12, the terminal plate 101 on the back-surface side of the amplifier is provided with a multiplicity of lever terminals 103 arranged in line.

Workers find difficulty in performing connection operations in the terminal plate 101 on the back surface of the amplifier, because the visibility of the work area is poor from the worker position. It is also extremely difficult to connect a multiplicity of lead wires 109 to their respective lever terminals 103 without fail.

Due to the difficulty of the connection operations, the lead wire 109 cannot be connected to the terminal with its skinned portions kept in a deeply-inserted state. Consequently, adjacent portions are brought into contact with each other, causing short circuits. Moreover, due to the poor visibility of the work area, the signal and ground wires, although they are usually distinguished from each other by their skin colors (red and black), might be inadvertently connected to reverse positions.

To overcome such inconveniences, a connection method as shown in FIG. 13 has been proposed that employs a plug 125. Specifically, a signal wire 121 and a ground wire 123, used in pairs as a lead wire 109, are attached to the plug 125, and this plug 125 is inserted into a socket 127 provided on an amplifier side.

That is, the end of each of the lead wires 121 and 123 is fixed in advance to its respective metal-made connector terminal 129. The connector terminal 129 is barrel-shaped, and its rear-end portion (left-end portion viewing the figure) has a U-shaped section. Upon insertion of the skinned end of the lead wire 109, the barrel is subjected to caulking, thereby fixing the lead wire 109 to the connector terminal 129. The connector terminal 129 has its substantially cylindrical front-end portion formed as a contact terminal 133, into which a pin terminal acting as an amplifier-side terminal 131 is inserted so as to be in contact therewith. These two connector terminals 129 with the lead wires 109 fixed thereto are received in their respective housing portions 135 formed in a single plug 125 so as to be retained.

Formed in a terminal plate 137 disposed on the back surface of the amplifier is a connection recess 139 constituting the socket 127 which is engaged with the plugs 125. Two apparatus-side terminals, or pin terminals 131, are formed inside the connection recess 139 protruding therein, these corresponding to the signal wire 121 and the ground wire 123, respectively.

To prevent the plug 125 from being inserted in a 180-degree inverted position, the connection recess 139 has a rib 141 formed on its inner side along the insertion direction so as to be protruded, and the plug 125 has, on its outer surface, a groove 143 which receives the rib 141. The plug 125 and its corresponding socket 127 have the same skin color.

In the connector shown in FIG. 13, (1) By providing the concave groove 143 and the rib 141 for the plug 125 and the socket 127, respectively, the plug 125 can be inserted in a proper position, thereby preventing the signal and ground wires from being connected in reversed polarity.

(2) By giving the plug 125 and its respective socket 127 the same skin color, the lead wire 109 can be connected to the speakers for a multi-channel system with no possibility of wrong wiring.

(3) Since the skinned portion of the lead wire 109 is not exposed, adjacent lead wires 109 do not make contact with each other. Consequently, short circuits can be prevented.

(4) In this connector, unlike the lever terminal 103 shown in FIG. 111 which requires two operations: rotation of the lever 105; and insertion of the lead wire 109, the connection operation can be completed simply by inserting the plug 125. Therefore, even though the back surface of the amplifier is not exposed to the worker view, the connection operation can be easily achieved with one hand.

However, the connector shown in FIG. 13 lacks versatility. For example, in a case where an audio enthusiast tries to connect a specially-designed thick lead wire to the speaker, whereas the lever terminal 103 shown in FIG. 11 conforms to such a requirement, the connector in question is unusable. That is, only the lead wire 109 attached in advance to the plug 125 may be acceptable.

To achieve both of the convenience of the plug 125 shown in FIG. 13 and the versatility of the lever terminal 103 shown in FIG. 11, two types of connectors, i.e. the socket 127 and the lever terminal 103, need to be provided in a single back-surface panel of an amplifier or the like. This leads to an undesirable increase in the number of constituent components, causing space shortage in the back-surface panel.

The above description deals only with problems associated with connection between an amplifier and a lead wire provided in a speaker. However, similar problems tend to occur when a lead wire, realized by using a signal and a ground wire in combination, is connected between another device constituting an acoustic or other apparatus.

OBJECTS AND SUMMARY OF THE INVENTION

The present invention solves the above-described problems, and accordingly its object is to provide a plug that prevents reverse insertion of a signal and a ground wire arranged in pairs, prevents occurrence of short circuits in adjacent lead wires, facilitates connection of the lead wires, and allows connection of lead wires of any other type, i.e. offers versatility.

To achieve the above object, according to a first aspect of the present invention, a plug for connecting a pair of lead wire comprising a first lead wire and a second lead wire to an apparatus, comprising:

a plug housing configured so as to be insertable into and withdrawable from a connection recess provided on an apparatus side;

a pair of plug-side contact terminals disposed inside the plug housing, the plug-side contact terminals being contacted by a pair of apparatus-side terminals corresponding to the first and second lead wires;

reverse insertion preventive means for providing the plug housing with an asymmetrical profile so that it is inserted into and withdrawn from the asymmetrically-configured connection recess only in a predetermined position; and connecting means for connecting a pair of plug-side contact terminals to the first and second lead wires, respectively, the connecting means being clamp means detachably attached to the first or second lead wires.

Being configured so as to be insertable into and withdrawable from the connection recess on the apparatus side and provided with the reverse insertion preventive means, the plug housing can be engaged with and connected to an apparatus-side socket, which is engaged with and connected to the plug with the lead wire attached thereto, the lead wire being, at its end, fixed to a connector terminal.

Being formed as clamp means, the connecting means is capable of connecting a lead wire of an arbitrary thickness to the plug-side contact terminal.

According to a second aspect of the present invention, in the plug according to the first aspect, the pair of lead wires are connected between an amplifier and a speaker in an audio apparatus. A socket provided in the amplifier or speaker constitutes the connection recess. The reverse insertion preventive means is composed of a recess and a projection fitted into the recess, the recess is formed in one of the connection recess and the plug housing and the projection is formed in the other of the connection recess and the plug housing.

It is possible to use a pair of lead wires of an arbitrary thickness for connection between the amplifier and the speaker.

The reverse insertion preventive means allows the plug to be inserted into the connection recess only in such a state that the recess and the projection are engaged with each other, thereby preventing the amplifier and the speaker from being connected to each other in reversed polarity.

According to a third aspect of the present invention, in the plug according to the first or second aspect, the clamp means comprises:

a plate spring formed integrally with the plug-side contact terminal; and a rotary lever rotatably supported by the plug housing, the rotary lever pressing the plate spring so that when the first or second lead wires are inserted into the plug housing, they will be clamped between the plate spring and the inner wall of the plug housing.

As the rotary lever is rotated, the plate spring is pressed, whereby the first or second lead wires are clamped between the plate spring and the inner wall of the plug housing, and is thereby electrically connected to the plug-side contact terminal which is integrally formed with the plate spring.

By rotating the rotary lever in a reverse direction, the pressure on the plate spring is released, whereby the first or second lead wires are unclamped and thus can be pulled out.

According to a fourth aspect of the present invention, the plug according to the third aspect further comprises:

a pressing pawl disposed in the rotary lever for applying a pressing force; and a pressing recess formed in a portion of the plate spring at which pressing force is applied, wherein the pressing pawl crosses over the pressing recess only when the rotary lever is rotated into an unclamped state.

In the clamped state, the pressing recess is pressed by the pressing pawl, whereby the rotary lever is settled in a rotation position to achieve clamping. Moreover, since the rotary lever is inhibited from rotating until the press pawl crosses over the pressing recess, it never occurs that the rotary lever is rotated into an unclamped state by an inadvertent external force.

According to a fifth aspect of the present invention, in the plug according to the first or second aspects, the clamp means comprises:

a plate spring formed integrally with the plug-side contact terminal; and a rotary lever rotatably supported by the plug housing, the rotary lever allowing the first or second lead wire, inserted into the plug housing, to be gripped and clamped between the plate spring and the plug housing.

As the rotary lever is rotated, the first or second lead wire is clamped between the plate spring and the inner wall of the plug housing, and is thereby electrically connected to the plug-side contact terminal which is formed integrally with the plate spring.

By rotating the rotary lever in a reverse direction, the first or second lead wire is unclamped and thus can be pulled out.

According to a sixth aspect of the present invention, in the plug according to the fifth aspect, the rotary lever is provided with an engagement portion. The rotary lever is, at its engagement portion, fitted into the plug housing when set in a rotation position so as for the first or second lead wire to be gripped between the plate spring and the plug housing, thus attaining a clamped state.

The rotary lever is engaged with the plug housing in a rotation position for achieving clamping, and is thus prevented from being rotated into an unclamped state by an inadvertent external force.

According to a seventh aspect of the present invention, in the plug according to the fifth or sixth aspect, a pair of clamp means have an integrally-formed rotary lever, in which by the rotation of the rotary lever, the first and second lead wires are clamped or unclamped concurrently.

The first and second lead wires can be concurrently clamped or unclamped by the rotation of the rotary lever.

According to an eighth aspect of the present invention, in the plug according to the first or second aspect, the clamp means comprises:

a contact plate formed integrally with the plug-side contact terminal;

a plate spring arranged opposite to the contact plate, the plate spring being loaded with a force that tends to move it toward the contact plate so as for the first or second lead wire to be gripped and clamped between the contact plate and the plate spring; and a push button for achieving unclamping by pressing the plate spring in a direction reverse to a force-loading direction.

The first or second lead wire is gripped between the contact plate and the plate spring which is loaded with a force that tends to move it toward the contact plate, and is thereby electrically connected to the plug-side contact terminal. When the push button is pressed, the plate spring is moved away from the contact plate, whereby the first or second led wire is unclamped and thus can be pulled out.

According to a ninth aspect of the present invention, in the plug according to the first or second aspect, the clamp means comprises:

a contact plate formed integrally with the plug-side contact terminal;

a pressing member arranged opposite to the contact plate, the pressing member allowing the first or second lead wire to be gripped and clamped between the contact plate and the pressing member;

elastic means for loading the pressing member with a force that tends to move it toward the contact plate; and a push button for achieving unclamping by pressing the pressing member in a direction reverse to a force-loading direction.

The first or second lead wire is gripped between the contact plate and the pressing member which is loaded by the elastic means with a force that tends to move it toward the contact plate, and is thereby electrically connected to the plug-side contact terminal. When the push button is pressed, the pressing member is moved away from the contact plate, whereby the first or second led wire is unclamped and thus can be pulled out.

According to a tenth aspect of the present invention, in the plug according to the ninth aspect, the contact plate, the pressing member, and the push button are each arranged in pairs corresponding to each of the first and second lead wires. Of these components, the pressing members and the push buttons are each disposed at both ends of an U-shaped member serving as the elastic means.

The elastic means is realized as an U-shaped member and thus serves also as a paired clamp means.

A pair of push buttons are grippingly pressed to unclamp the first and second lead wires concurrently.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5 is a plan view of a plug 2 of a second plug embodiment according to the present invention.

FIG. 6 is a side view of the plug 2.

FIG. 7 is a cross sectional view showing the plug 2 in an unclamped state, taken along line A—A of FIG. 5.

FIG. 8 is a cross sectional view wherein the plug 2, in a clamped state, is inserted into the socket 127.

FIGS. 9A and 9B are views of a third plug embodiment according to the present invention, FIG. 9A showing a cross sectional view of the plug taken in a position of a push button 55, and FIG. 9B showing a perspective view of a plug-side contact terminal 25, a contact plate 57, and a plate spring 59 that are formed integrally with one another.

DETAILED DESCRIPTION OF THE PREFERRED EMBODIMENTS

Hereinafter, one embodiment of the present invention will be described with reference to FIGS. 1 to 4.

Figure 1:
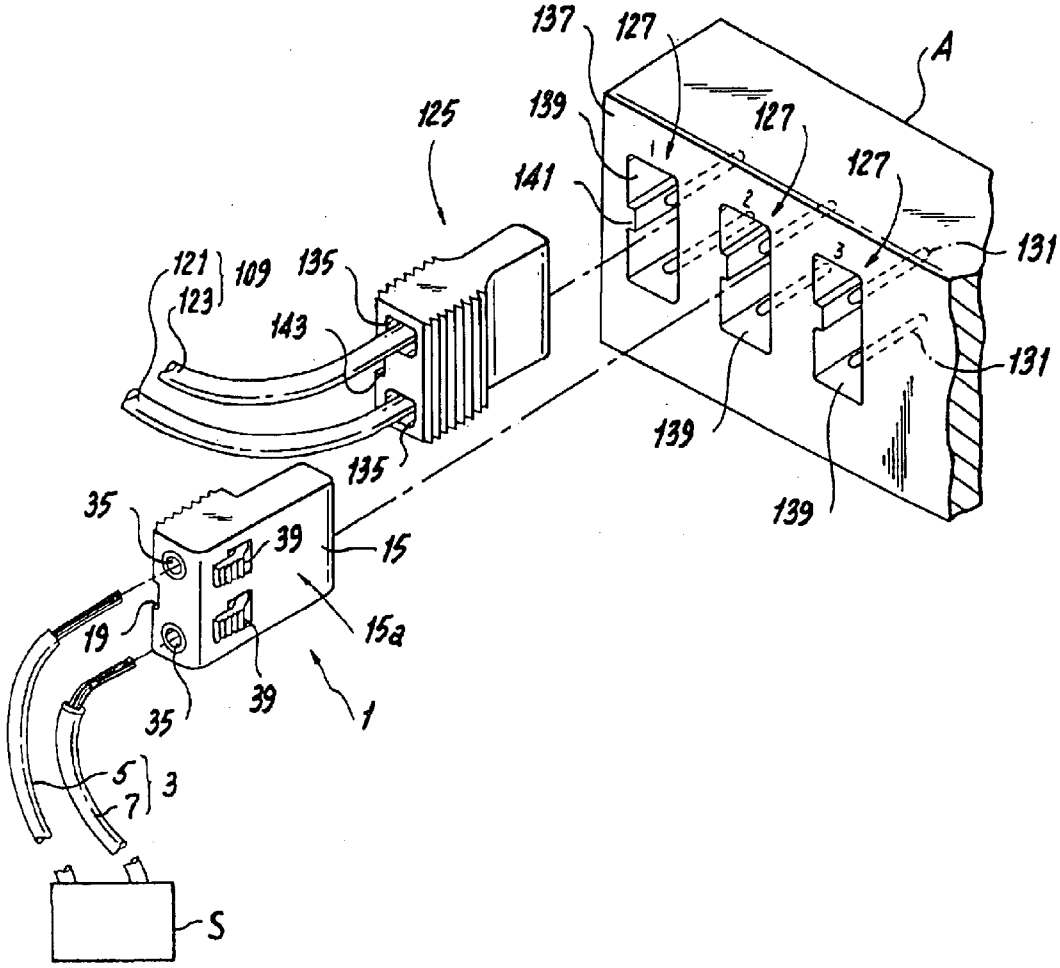
FIG. 1 is a perspective view of a first plug embodiment according to the present invention, wherein the plug 1 is connectable to a socket 127 designed for use with a conventional plug 125.

As shown in FIG. 1, a lead wire 3 to be connected to a plug 1 is realized by using a signal wire 5, serving as a first lead wire, and a ground wire 7, serving as a second lead wire, in combination. The lead wire 3 is connected between an amplifier A and a speaker S of an audio apparatus as shown in FIG. 1.

That is, a single plug 1 is provided to receive both of the ends of the signal wire 5 and the ground wire 7 for connection to the speaker side. The plug 1 is inserted into a connection recess 139 constituted by a socket 127 which is formed in a terminal plate 137 provided on the back surface of the amplifier. As shown in FIG. 1, the socket 127 can also be fitted into the above-described plug 125 of the prior art example so as to be connected therewith. Hence, the socket 127 will be identified with the same reference number and detailed descriptions thereof will be omitted.

A plug housing 15 has a rectangular vertical cross section which is substantially identical with but is slightly smaller than the vertical cross section of the connection recess 139. The plug 1, just as with the plug 125, is so configured as to be insertable into and withdrawable from the connection recess 139. Moreover, the connection recess 139 has a projection, as a rib 141, formed on its inner surface. The plug housing 15 has a recess, as, e.g., a concave, a rectangular, or like cross section groove 19, formed on its outer surface. The groove 19 receives the rib 141 during insertion. Providing the rib 141 and the groove 19 makes asymmetrical the configuration of each of the connection recess 139 and the plug housing 15.

The connection recess 139 has two pin terminals, as apparatus-side terminals 131, fixed to its inner part. The apparatus-side terminals 131 are so formed as to protrude toward the opening of the connection recess 139.

Figure 2:
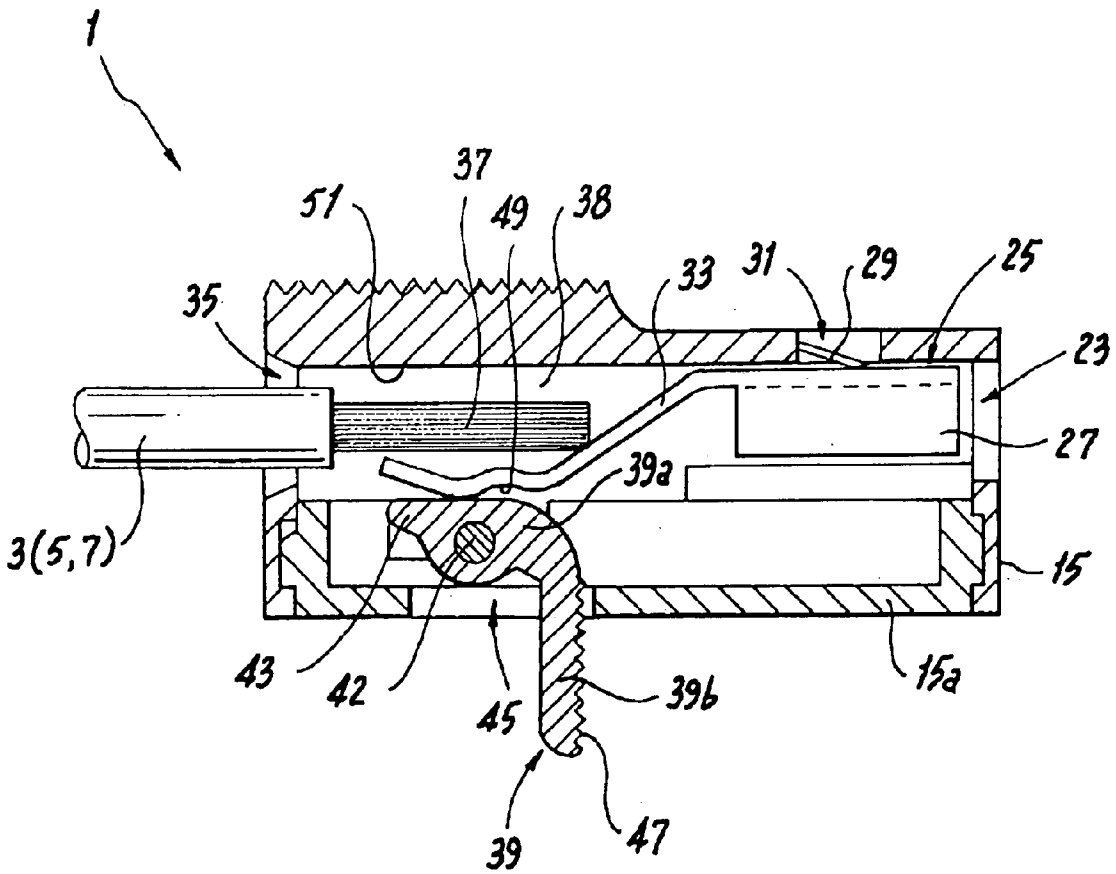
FIG. 2 is a cross sectional view showing the plug 1, in its unclamped state, i.e., the rotary lever 39 being in its non-clamping position.

As shown in FIG. 2, the plug housing 15 has, on its front surface, a terminal insertion hole 23 into which the apparatus-side terminal 131 is inserted. Inside the terminal insertion hole 23 is situated a substantially cylindrical portion 27 of a plug-side contact terminal 25. That is, the substantially cylindrical portion 27 is split in half, and its elasticity maintains the elastic engagement of the pin terminal acting as the apparatus-side terminal 131.

The plug-side contact terminal 25 has an engagement pawl 29 engageable with an engagement window 31 of the plug housing. The engagement pawl 29 is obtained by cutting and raising part of the plug-side contact terminal 25. When the plug-side contact terminal 25 is inserted into the plug housing 15 from the rear (left-hand side viewing the figure), the engagement pawl 29 is engaged in the engagement window 31, thereby preventing the plug-side contact terminal 25 from being slipping off.

The plug-side contact terminal 25 has a plate spring 33 formed integrally and contiguously therewith that extends toward the rear side of the inner part of the plug housing 15. Formed on the rear surface of the plug housing 15 is an insertion hole 35 for insertion of the lead wire 3. A skinned portion 37 of the lead wire 3 is inserted through the insertion hole 35 to reach a position where it is arranged side by side with the plate spring 33. Then, as will be described later, the lead wire 3 is sandwiched between the elastically deformable plate spring 33 and an inner wall 51 of the plug housing 15.

The plug housing 15 has a rectangular section elongated in a direction in which the two plug-side contact terminals 25 are arranged. Rotatably on a side wall 15*a* of the plug housing 15 is attached a rotary lever 39 for pressing the plate spring 33. The entire rotary lever 39 has the shape of an inverted L. Of two arm portions defining the reversed L configuration, an arm portion 39*a* has, at its end, a pressing pawl 43 for applying a pressing force, and has, on both sides, a rotary shaft 41 which is protrudingly formed so as to rotate with respect to the side wall 15*a*.

The other arm portion 39*b* defining the L configuration comes out of the plug housing 15 through a lever window 45 piercingly formed on the side wall 15*a*. On the surface of its exposed portion is formed a non-slip portion 47.

Figure 3:
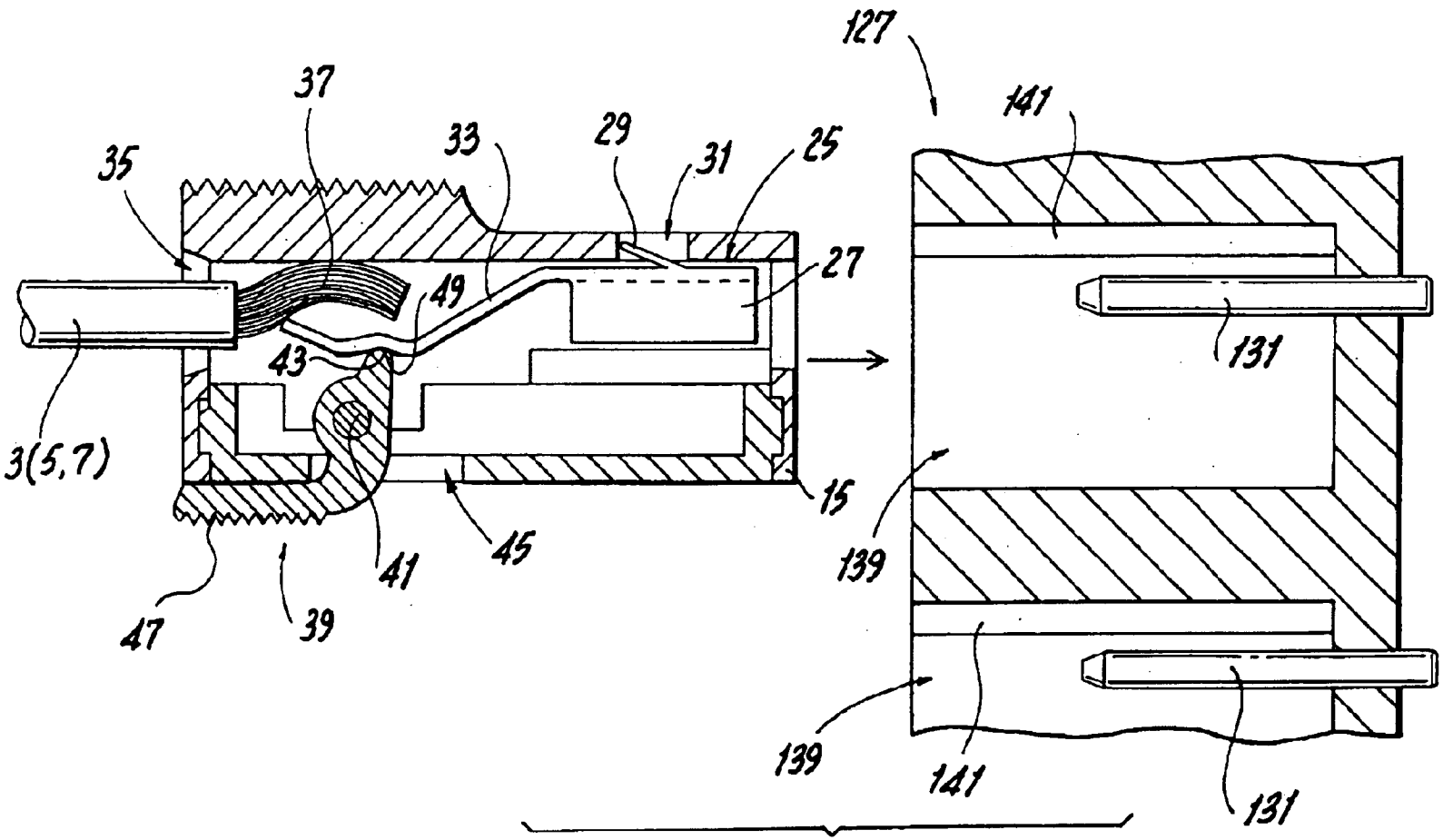
FIG. 3 is a cross sectional view showing a case where the plug 1, which has been driven from the state shown in FIG. 2 to a clamped state, is inserted into the socket 127.
Figure 4:
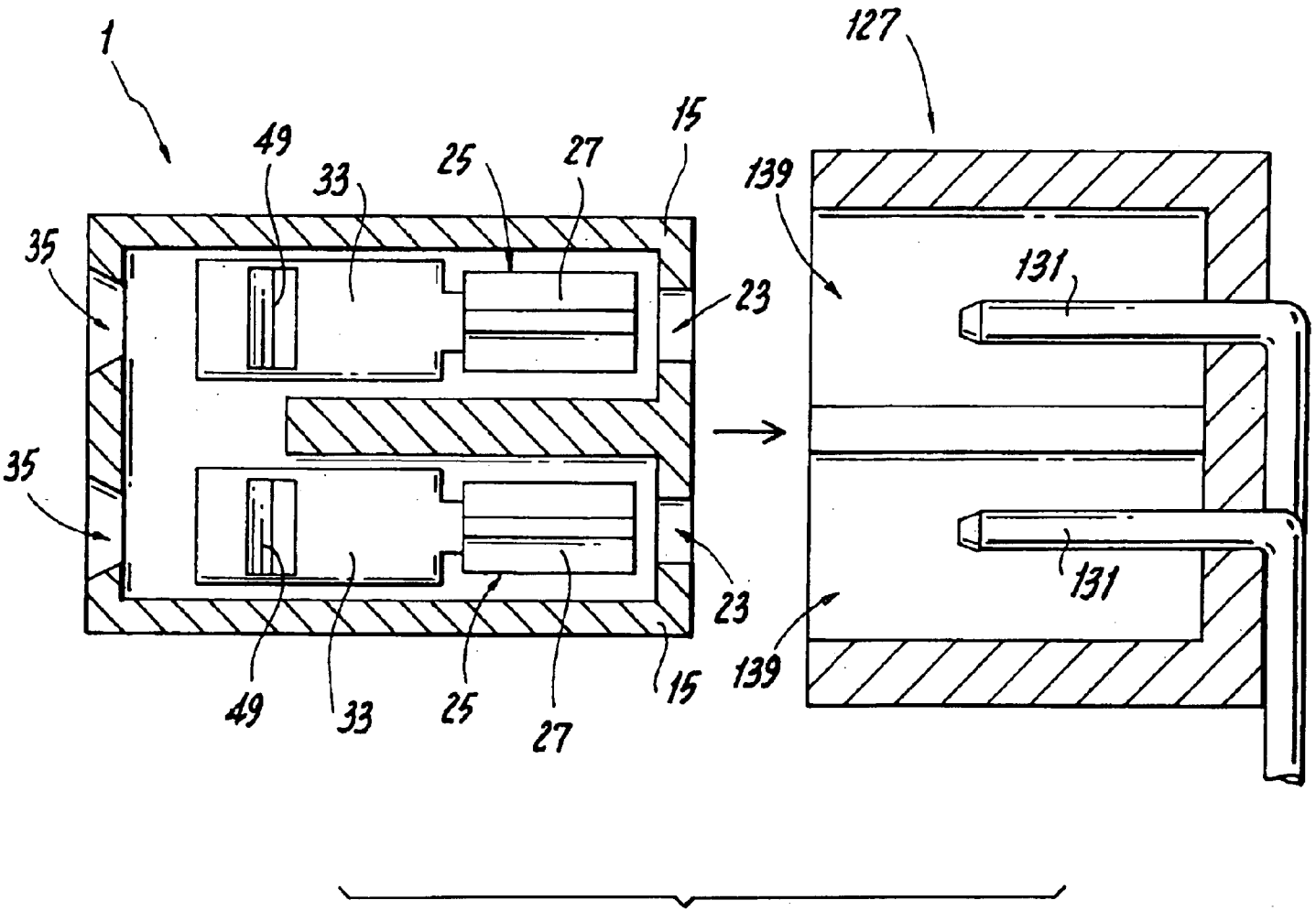
FIG. 4 is a vertical sectional view of the plug 1 and the socket 127 shown in FIG. 3, sectioned along a terminal insertion hole 23 of the plug 1.

As shown in FIG. 3, the plate spring 33 has, in its portion to be pressed by the pressing pawl 43, a pressing recess 49 which acts to position the rotary lever 39 in a state where the lead wire 3 is clamped, to pull on the lead wire 3, and to prevent the rotary lever 39 from being rotated by an unexpected external force. Thus, the depth of the pressing recess 49 is determined such that the rotary lever 39, on the one hand, cannot be easily rotated by an unexpected external force, and, on the other hand, is rotated to allow the pressing pawl 43 to cross over the pressing recess 49 when some operating force is exerted thereon.

The above-described constituent components including the terminal insertion hole 23, the plug-side contact terminal 25, the insertion hole 35, and the rotary lever 39 are each provided in pairs corresponding to each of the signal and ground wires 5 and 7, and the two components constituting each pair are disposed in the upper and lower portions of the plug housing 15, respectively, in the lengthwise direction.

To connect the lead wire 3, i.e. the signal wire 5 or the ground wire 7, to the plug 1 and as shown in FIG. 2, the outer arm portion 39*b* of the rotary lever 39 is raised by rotation to attain an unclamped state. Then, the plate spring 33 is moved away from the inner wall 51 of the plug housing 15 under its own elastic force, thereby creating an insertion space 38 for inserting the lead wire 3 between the inner wall 51 and the plate spring 33.

In this state, the skinned portion 37 of the lead wire 3 is inserted through the insertion hole 35 to reach the insertion space 38. Thereafter, the outer arm portion 39*b* of the rotary lever 39 is lowered by rotation (rotated in a clockwise direction viewing the figure) to attain a clamped state. Then, the pressing pawl 43 of the rotary lever 39 presses the plate spring 33, thereby clamping the lead wire 3 between the plate spring 33 and the plug housing inner wall 51.

As shown in FIG. 3, as the rotary lever 39 is fully rotated to be parallel with the side wall 15*a*, the pressing pawl 43 is located in the pressing recess 49 of the plate spring 33, so that the clamped state is maintained.

With such a clamp structure, the signal wire 5 and the ground wire 7 are respectively fixed to the plug 1, thereby completing fixation of the lead wire 3. Subsequently, the plug 1 is inserted into the connection recess 139 of the socket 127. The insertion of the plug 1 can be successfully achieved only when the rib 141 of the connection recess 139 is fitted into the groove 19 of the plug 1. This structure prevents the plug 1 from being inserted in a 180-degree inverted position, so that the signal and ground wires 5 and 7 cannot be connected to the pin terminals 131 in reversed polarity.

Moreover, the plug 1 and its corresponding socket 127 may have the same skin color (red, yellow, blue, green, black, or white), so that wiring cannot be carried out on the wrong speaker.

Given that an audio enthusiast makes a modification to the signal and ground wires 5 and 7 to make a special, thick lead wire for connection. In this case, the rotary lever 39 is raised to remove the existing lead wire 3, then the new lead wire, which has already been skinned, is inserted, and then the rotary lever 39 is lowered. Thereupon, the special lead wire can be connected to the plug with ease, and the plug 1 with the lead wire is connected to the apparatus-side socket 127.

The connection between the lead wire 3 and the plug 1, unlike the case of a conventional lever terminal, need not be performed in the back-surface panel of the amplifier, and therefore workers can perform the connection operation smoothly without suffering from poor visibility. Consequently, the lead wire 3 can be connected to the plug 1 with its skinned portion 37 kept in a deeply-inserted state, thereby preventing short circuits caused by the contact among adjacent skinned portions.

Moreover, as shown in FIG. 1, to the socket 127, the conventional plug 125 can be fitted to be connected therewith. Attached to the conventional plug 125 is the lead wire 109 press-fitted to the connector terminal 129. Thus, connection of the plug 1, attached to the lead wire 3 having been modified to suit the user preferences, can be achieved without changing the socket 127 structure which constitutes the conventional connection structure together with the plug 125.

Although, in the above embodiment, the clamped state is maintained by the pressing recess 49 formed on the plate spring 33, the pressing recess 49 may be omitted by forming another securing means in the rotary lever 39.

FIGS. 5 to 8 show a second embodiment of the plug 2 according to the present invention. The second embodiment differs from the first embodiment in the clamp means for clamping the lead wire 3. In the second embodiment, the lead wire 3 is gripped and clamped between a rotary lever 11 and a plate spring 13. The rotary lever 11 is rotatably supported with respect to a plug housing 9.

In the second embodiment, the components that play the same or corresponding roles as in the first embodiment will be identified with the same reference numbers, and overlapping descriptions will be omitted.

The plug housing 9 is formed in the shape of rectangular parallelopiped and is insertable into and withdrawable from the connection recess 139 provided in the socket 127. The plug housing 9 has an insertion hole 35 drilled in its rear surface 9*a*. The plate spring 13, which is contiguous to the plug-side contact terminal 25, is folded to a generally U-shape in the direction toward the rear of the contact terminal, and its free end lies within the insertion hole 35, as shown in FIG. 7.

The rotary lever 11 has, at the front of its side surface, a rotary shaft 12 formed so as to protrude vertically. The rotary shaft 12 is rotatably supported on a side wall 9*b* of the plug housing 9, so that the rotary lever 11 is openable and closeable with respect to the side wall 9*b*. At the rear of the rotary lever 11, a pair of protruding pressing projections 14 are formed. When the rotary lever 11 is rotated parallely with the side wall 9*b* to be set in a clamp position, the pressing projections 14 are inserted through lever windows 45, respectively drilled in upper and lower parts of the side wall 9*b*, to protrude into upper and lower insertion holes 35. When protruding into the insertion hole 35, the front end of the pressing projection 14 abuts against and presses the plate spring 13 which also lies in the insertion hole 35.

The pressing projection 14 has, on the basal-end side of its rear surface, an engagement projection 16 which is engaged with part of the side wall 9*b* acting as the rear edge of the lever window 45. As shown in FIG. 8, the engagement projection 16 keeps the rotary lever 11 in the clamp position.

According to the second embodiment, as shown in the figures, the constituent components including the plate spring 13, the insertion hole 35, and the pressing projection 14 are each provided in pairs corresponding to each of the signal and ground wires 5 and 7, and the two components constituting each pair are disposed in the upper and lower portions of the plug housing 9, respectively, in the lengthwise direction. On the other hand, a single rotary lever 11 can be shared, so that the signal and ground wires 5 and 7 are clamped or unclamped concurrently.

As shown in FIG. 7, as the rotary lever 11 is rotated to be set in an unclamp position, enough space can be secured in the insertion hole 35 for the insertion of the lead wire 3. Thus, the skinned front end of the lead wire 3 can be inserted into the insertion hole 35 until it reaches the side surface of the plate spring 13.

Subsequently, the rotary lever 11 is rotated with the side wall 9*b* to be set in the parallel clamp position. Then, as shown in FIG. 8, the inserted lead wire 3 is sandwiched and clamped between the plate spring 13 and the pressing projection 14 of the operation lever 11. As a result, the lead wire 3 is electrically connected to the plug-side contact terminal 23.

In this clamped state, the engagement projection 16 is engaged with the rear edge of the lever window 45. This prevents the rotary lever 11 from rotating inadvertently, so that the clamped state is maintained. Next, upon insertion of the plug 2, to which the lead wire 3 is connected, into a connection recess 13 of the socket 127, the paired lead wires 5 and 7 are each electrically connected via the plug-side contact terminal 25 to the apparatus-side terminal 131.

As shown in FIG. 8, during the time the plug 2 is inserted into the connection recess 139 of the socket 127 for connection, the rotary lever 11 is inhibited from further rotation by the inner wall of the connection recess 139 while being set in the clamp position. This, in addition to the action of the engagement projection 16, prevents the rotary lever 11 from rotating into the unclamp position more reliably, so that the lead wire 3 never slips off inadvertently.

In the first and second embodiments, clamping is achieved by rotating the rotary lever (39 and 11) toward the plate spring (33 and 13). However, as in a third embodiment shown in FIG. 9, it is also possible to achieve clamping and unclamping at the touch of a push button 55.

That is, in the third embodiment, a plate spring 59 is arranged opposite to a contact plate 57 formed integrally with the plug-side contact terminal 25, so that the lead wire 3, i.e. the signal or ground wire 5 or 7, is clamped between the contact plate 57 and the plate spring 59. The push button 55 is so arranged as to face the contact plate 57 and is made rotatable about a rotary shaft 61. Part of the push button 55 protrudes through a button window 63 of the plug housing 15 to allow a finger to be placed thereon from outside. The push button 55 has a pressing projection 65 formed in its portion located on the inner side of the plug housing 15. The pressing projection 65 presses the plate spring 59. The plate spring 59 is made longer than the contact plate 57 and extends outward beyond the edge of the contact plate 57, and its extended portion 67 is pressed by the pressing projection 65. The pressing projection 65 is so arranged as to face the end of the plate spring 59 so as not to stand in the way of the lead wire 3 within the insertion space 38.

According to the third embodiment, as the pressure on the plate spring 59 is released, the lead wire is clamped under the resilient force of the plate spring 59 per se. Thus, even though part of the clamp means is broken, the clamped state, i.e. the connection of the lead wire 3, can be maintained.

Figure 10:
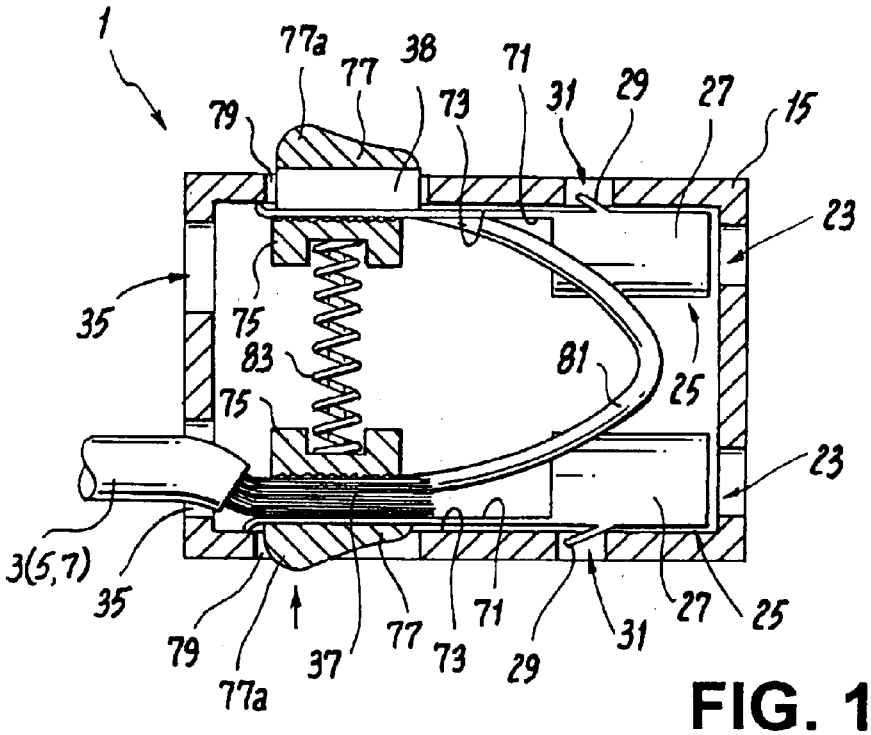
FIG. 10 is a vertical sectional view showing yet another plug embodiment according to the present invention.
Figure 11:
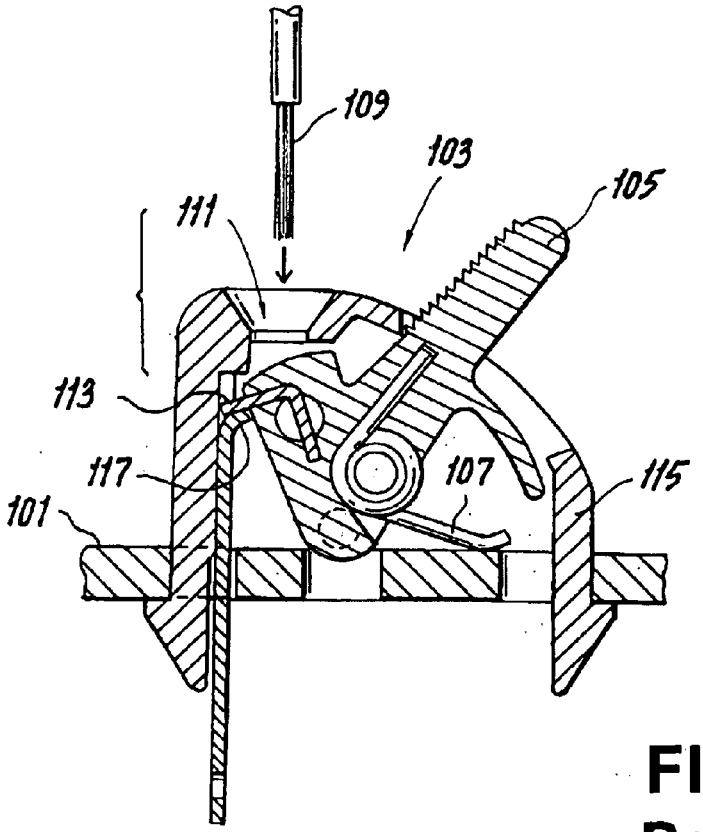
FIG. 11 Prior Art
FIG. 11 is a vertical sectional view showing a conventional lever terminal 103.
Figure 12:
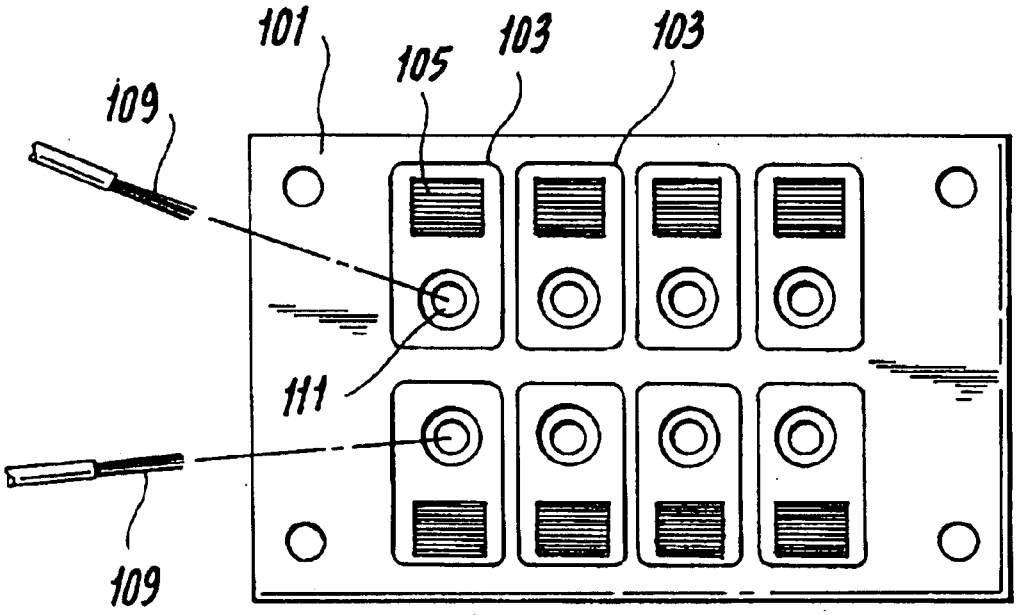
FIG. 12 Prior Art
FIG. 12 is a front view of a terminal plate 101, provided on the back surface of an audio apparatus, in which a multiplicity of lever terminals 103 as shown in FIG. 11 are disposed.
Figure 13:
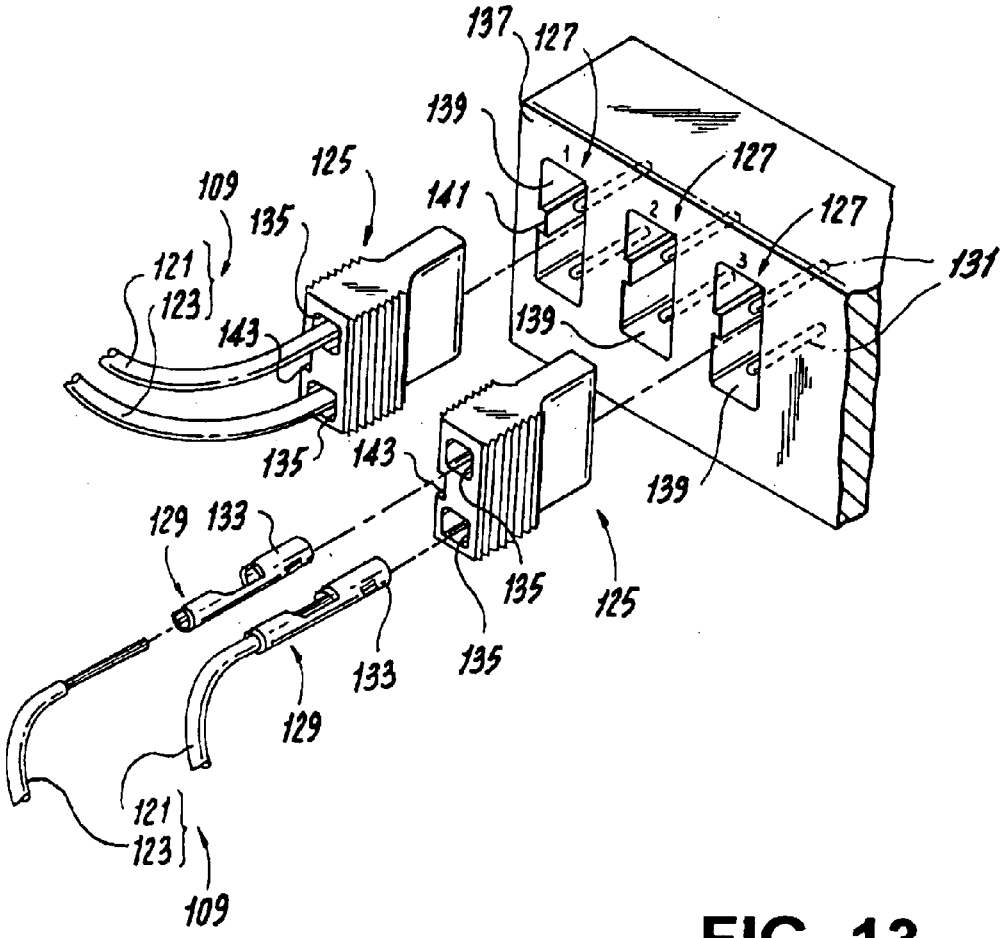
FIG. 13 Prior Art
FIG. 13 is a perspective view showing the structure of a connector composed of conventional plug 125 and socket 127.

FIG. 10 shows yet another plug embodiment of the present invention having clamp means configured differently from those of the above-described embodiments. A contact plate 71, formed integrally with the plug-side terminal 25, is disposed along upper and lower inner walls 73 of the plug housing 15. A pressing member 75 is arranged opposite to the contact plate 71. The skinned portion 37 of the lead wire 3 is clamped between the pressing member 75 and the contact plate 71.

A push button 77 is formed from an insulative plastic material integrally with the pressing member 75. An operation portion 77*a* of the push button 77 protrudes through a button window 79, which is drilled in the front and bottom surfaces of the plug housing 15, to allow a finger to be placed thereon from outside.

The plug-side contact terminal 25, the contact plate 71, the pressing member 75, and the push button 77 are each provided in pairs corresponding to each of the paired lead wires 5 and 7 for connection. Of these components, the pressing member 75 and the push button 77 are disposed on both sides of a U-shaped member 81. The U-shaped member 81 is formed from a plastic material integrally with the push button 77 and the pressing member 75. Being formed in the shape of the letter the U-shaped member 81 possesses elasticity and serves as elastic means for loading the pressing member 75 with a force that tends to move it vertically (outwardly of the plug housing 15).

Both of the pressing members 75 are also loaded with a force by an auxiliary spring 83 serving as auxiliary elastic means.

To connect the lead wire 3, at first, the push buttons 77 are taken with the operator fingers so as for the pressing member 75 to move toward the inner side of the plug housing 15. By doing so, an insertion space 38 can be secured between the pressing member 75 and the contact plate 71 for insertion of the lead wire 3. In this state, after the lead wire 3 is inserted into the insertion hole 35, the push button 77 is released. Then, the push button 77 and the pressing member 75 try to return to their original positions under the elasticity of the U-shaped member 81 or the auxiliary spring 83, whereby the lead wire 3 is clamped between the pressing member 75 and the contact plate 71.

In this case, the U-shaped member 81 serves as elastic means and thus the auxiliary spring 83 does not necessarily have to be provided. In a case where a spring like the auxiliary spring 83 is used, there is no need to make the U-shaped member 81 elastic means. By making the central portion of the U-shaped member 81 a hinge-connected portion, the U-shaped member 81 acts merely as positioning means for the push button 77 and the pressing member 75.

According to this embodiment, since the unclamped state is attained in such a condition that the push button 77 is released to activate the U-shaped member 81 and the auxiliary spring 83, it is possible to achieve clamping with stability. Moreover, by the two push buttons 77, pressing force is applied from above and below to the plug housing 15 formed in the shape of rectangular parallelopiped, thereby obtaining a large press allowance. With this arrangement, a sufficiently wide insertion space 38 can be secured, and further, the width of the plug housing 15 can be reduced, so that the plug is made slimmer.

In the above-described embodiment, the plug-side contact terminal 25 is formed in a substantially cylindrical shape and is fitted into a pin terminal acting as the apparatus-side terminal 131 so as to be connected therewith. However, the plug-side contact terminal 25 may have any given shape so long as it is electrically connected.

Moreover, in the above-described embodiment, the apparatus-side terminal 131 is built as a pin terminal, and the plug-side contact terminal 25 is substantially cylindrical in shape and split in half. However, they do not necessarily have to have such configurations. For example, the following design may be adopted. Of the apparatus-side terminal 131 and the plug-side contact terminal 25, one is formed as a flat terminal, and the other is formed as a terminal having elasticity. Upon insertion of the plug 1 (and 2), these two terminals make elastic contact with each other.

Further, in the above-described embodiment, the connection recess 139 and the plug housing 15 each have an asymmetrical section. This is achieved by providing the former with the rib 141 and the latter with the groove 19. However, the other embodiments may have such a structure that the connection recess 139 is provided with the groove 19 and the plug housing 15 is provided with the rib 141.

Further, in the above-described embodiment, the connection recess 139 and the plug housing 15 each have a substantially quadrangular section. To impart asymmetricity to their sections, the rib 141 and the groove 19 are provided. However, in the other embodiments, the asymmetricity can be realized by any other manner than is described above. For example, the section may be shaped to be in the form of a scalene triangle, instead of a quadrangle.

Still further, although, in this specification, the lead wire is illustrated as a combination of the signal wire 5 and the ground wire 7, the pair to the lead wire is not limited to a ground wire.

As described heretofore, according to the present invention, a lead wire, such as a signal or ground wire, can be connected to a plug by means of attachable/detachable clamp means. This allows easy connection of a specially-designed, for example, a thick lead wire, achieving versatility.

Since the plug is so configured as to be fitted into and connected with the socket designed for use with a conventional plug to which a pair of lead wires is connected, it is possible to use the plug, which allows connection of any type of lead wire, while maintaining the structure for providing connection between the conventional plug and socket.

Further, in conformity with the asymmetrical configuration of the connection recess, the plug housing is given an asymmetrical profile. This prevents the signal and ground wires from being connected in reversed polarity.

Still further, the signal and ground wires, taken as a pair, are connected to the plug in advance. Thus, connection can be achieved simply by inserting the plug into the connection recess. That is, the connection operation can be easily achieved with one hand.

The lead wire can be connected to the plug at any given location regardless of the position of the socket. This enables workers to smoothly perform connecting operations without suffering from poor visibility. This prevents occurrence of wrong connection, as well as short circuits caused by the contact among the skinned portions of the lead wire.

While there has been described what are at present considered to be preferred embodiments of the invention, it will be understood that various modifications may be made thereto, and it is intended that the appended claims cover all such modification as fall within the true spirit and scope of the invention.

What is claimed is:

1. A plug for connecting a pair of lead wires comprising a first lead wire and a second lead wire to an apparatus, comprising:

a plug housing configured so as to be insertable into and withdrawable from a connection recess provided on an apparatus side;

a pair of plug-side contact terminals disposed inside the plug housing, the plug-side contact terminals being contacted by a pair of apparatus-side terminals corresponding to the first and second lead wires;

an engagement pawl on each of said plug-side contact terminals is engageable with an engagement window disposed on the plug housing;

reverse insertion preventive means including cooperative asymmetrically configured structure on said plug housing and on said connection recess so that said plug housing is insertable in said connection recess only when said plug housing is in a predetermined orientation;

connecting means for connecting said pair of plug-side contact terminals to said first and second lead wires, respectively, said connecting means comprising clamp means detachably attachable to said first or second lead wires;

wherein said clamp means comprises:

a plate spring formed integrally with said plug-side contact terminals and a rotary lever rotatably supported by said plug housing, said rotary lever being operable in a first direction when said first lead wire and said second lead wire have been inserted into said plug housing for pressing said plate spring such as to clamp said first and second wires between said plate spring and an inner wall of said plug housing, and being operable in a second direction to allow said plate spring to flex itself away from said wires such as to unclamp said wires.

2. The plug according to claim 1, wherein the pair of lead wires are connected between an amplifier and a speaker in an audio apparatus, a socket provided in the amplifier and said speaker constituting said connection recess, said cooperative asymmetrical structure comprising a recess in one of said plug housing and said connection recess, and a projection carried on a other of said plug housing and said connection recess.

3. The plug according to claim 1, further comprising:

a pressing pawl carried on said rotary lever for applying a pressing force; and a pressing recess formed in a portion of said plate spring where pressure is to be applied to said plate spring, wherein said pressing pawl crosses over said pressing recess only when said rotary lever is rotated into an unclamped state.

4. A plug for connecting a pair of lead wires comprising a first lead wire and a second lead wire to an apparatus, comprising:

a plug housing configured so as to be insertable into and withdrawable from a connection recess provided on an apparatus side;

a pair of plug-side contact terminals disposed inside the plug housing, the plug-side contact terminals being contacted by a pair of apparatus-side terminals corresponding to the first and second lead wires;

an engagement pawl on each of said plug-side contact terminals is engageable with an engagement window disposed on the plug housing;

reverse insertion preventive means including cooperative asymmetrically configured structure on said plug housing and on said connection recess so that said plug housing is insertable in said connection recess only when said plug housing is in a predetermined orientation;

connecting means for connecting said pair of plug-side contact terminals to said first and second lead wires, respectively, said connecting means comprising clamp means detachably attachable to said first or second lead wires; wherein said clamp means comprises:

a plate spring formed integrally with said plug-side contact terminals; and a rotary lever rotatably supported by said plug housing, said rotary lever when operated in a first direction enabling said first or second lead wire, when inserted into said plug housing to be gripped and clamped between said plate spring and said plug housing and when operated in a second direction enabling said plate spring to flex itself away from said wires such as to unclamp said wires.

5. The plug according to claim 4, wherein said rotary lever includes an engagement portion, said rotary lever, at its engagement portion, being fitted into said plug housing when set in a rotation position to allow said first or second lead wires to be gripped between said plate spring and said plug housing in a clamped state thereof.

6. The plug according to claim 4, wherein said clamp means comprises a pair of pressing projections integrally formed with said rotary lever, a rotation of said rotary lever enabling clamping and unclamping of said first and second lead wires concurrently.

7. A plug for connecting a pair of lead wires comprising a first lead wire and a second lead wire to an apparatus, comprising:

a plug housing configured so as to be insertable into and withdrawable from a connection recess provided on an apparatus side;

a pair of plug-side contact terminals disposed inside the plug housing, the plug-side contact terminals being contacted by a pair of apparatus-side terminals corresponding to the first and second lead wires;

reverse insertion preventive means including cooperative asymmetrically configured structure on said plug housing and on said connection recess so that said plug housing is insertable in said connection recess only when said plug housing is in a predetermined orientation;

connecting means for connecting said pair of plug-side contact terminals to said first and second lead wires, respectively, said connecting means comprising clamp means detachably attachable to said first or second lead wires;

wherein said clamp means comprises:

a contact plate and a pressing member, both formed integrally with each of said plug-side contact terminals; said pressing member arranged opposite said contact plate, said pressing member being loaded with a force tending to move said pressing member toward said contact plate for enabling gripping and clamping of said first and second lead wires between said contact plate and said pressing member; and a push button operable for pressing said pressing member in a direction opposite to an action direction of said force-load for effecting unclamping of said first and second lead wires from said clamp means.

8. A plug for connecting a pair of lead wires comprising a first lead wire and a second lead wire to an apparatus, comprising:

a plug housing configured so as to be insertable into and withdrawable from a connection recess provided on an apparatus side;

a pair of plug-side contact terminals disposed inside the plug housing, the plug-side contact terminals being contacted by a pair of apparatus-side terminals corresponding to the first and second lead wires;

reverse insertion preventive means including cooperative asymmetrically configured structure on said plug housing and on said connection recess so that said plug housing is insertable in said connection recess only when said plug housing is in a predetermined orientation;

connecting means for connecting said pair of plug-side contact terminals to said first and second lead wires, respectively, said connecting means comprising clamp means detachably attachable to said first or second lead wires; and wherein said clamp means comprises:

a contact plate formed integrally with said plug-side contact terminals; a pressing member arranged opposite said contact plate, said pressing member enabling said first and second lead wires to be gripped and clamped between said contact plate and said pressing member;

elastic means for loading said pressing member with a force that tends to move said pressing member toward said contact plate, said elastic means acting as a positioning means for said push button and said pressing member; and a spring loaded push button operable for compressing said spring and pressing the pressing member in a direction opposite said elastic means force loading direction for effecting unclamping of said first and second lead wires from said clamp means.

9. The plug according to claim 8, wherein said contact plate, said pressing member, and said push button are each arranged in pairs corresponding to each of said first and second lead wires, said pressing members and said push buttons being disposed at each of opposite ends of a U-shaped elastic means member.

* * * * *